United States Patent [19]

Jachno

[11] Patent Number: 4,594,010

[45] Date of Patent: Jun. 10, 1986

[54] WIRE MATRIX PRINT HEAD

[75] Inventor: Alex Jachno, Nyack, N.Y.

[73] Assignee: Bsr, Ltd., Santa Clara, Calif.

[21] Appl. No.: 603,232

[22] Filed: Apr. 23, 1984

[51] Int. Cl.[4] ..... B41J 3/12

[52] U.S. Cl. ..... 400/124; 101/93.05

[58] Field of Search ..... 400/124; 101/93.05; 335/275, 276

[56] References Cited

U.S. PATENT DOCUMENTS

| | | | |
|---|---|---|---|
| 4,230,038 | 10/1980 | Hebert | 101/93.05 |
| 4,230,412 | 10/1980 | Hebert | 101/93.05 X |
| 4,240,756 | 12/1980 | Ku et al. | 101/93.05 X |
| 4,260,270 | 4/1981 | Cavallari | 101/93.05 X |
| 4,382,701 | 5/1983 | Davenport | 400/124 |
| 4,423,969 | 1/1984 | Kobryn | 101/93.05 X |
| 4,447,166 | 5/1984 | Ochiai et al. | 400/124 |

*Primary Examiner*—Paul T. Sewell

*Attorney, Agent, or Firm*—Fitch, Even, Tabin & Flannery

[57] ABSTRACT

A wire matrix print head is disclosed including a plurality of print wires movable through supporting guides between print and non-print positions, springs urging the print wires toward their non-print positions with separate rigid armatures being movable by respective electromagnetic units from a rest position toward a print position for engaging a respective print wire and driving it toward and into its print position. A housing for supporting and accurately positioning the print wires, armatures and electromagnetic units relative to each other includes multiple portions which are interconnected in spaced apart relation about their peripheries in order to establish and maintain accurate positioning of the armatures relative to the respective electromagnetic units and print wires. While one housing portion supports and positions the electromagnetic units, another housing portion provides a pivot precisely spaced apart from an edge of each electromagnetic unit for capturing and permitting pivotable movement of the armatures therebetween. Each armature is engaged by a resilient bushing adjacent its pivot point, the bushing being slightly compressed in order to permit dampened pivoting movement maintain accurate positioning of the respective armature. A reaction element is secured to the housing for establishing a reaction surface for the armatures in order to limit return of the armatures to their rest or non-print positions.

14 Claims, 17 Drawing Figures

FIGURE 1
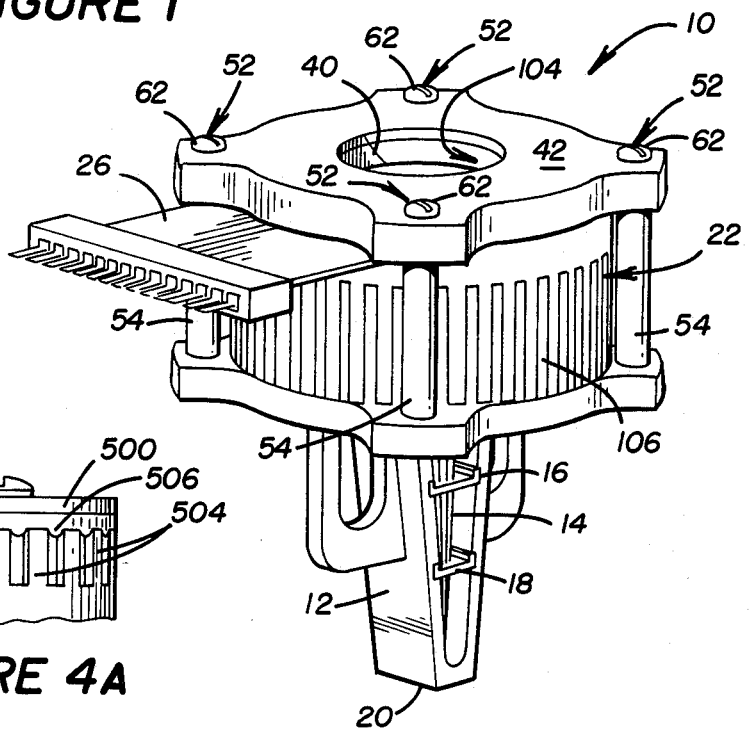
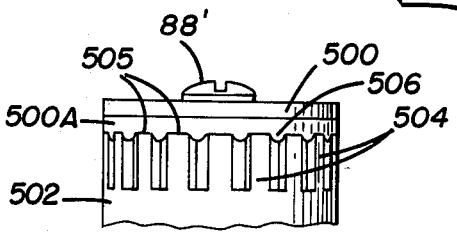
FIGURE 4A
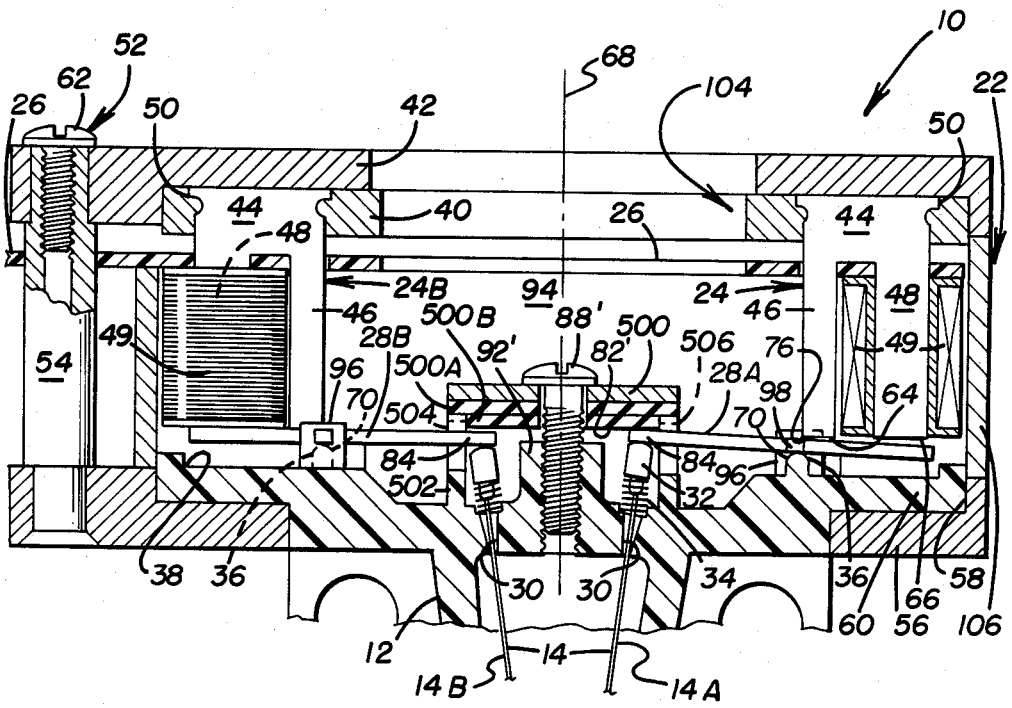
FIGURE 4

FIGURE 7
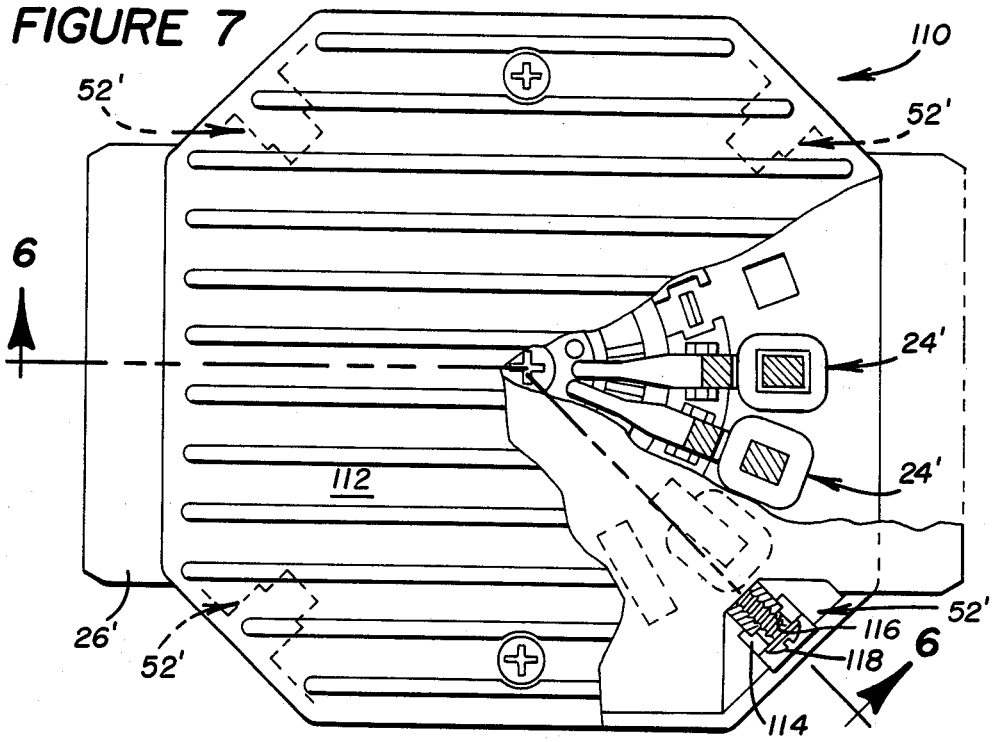
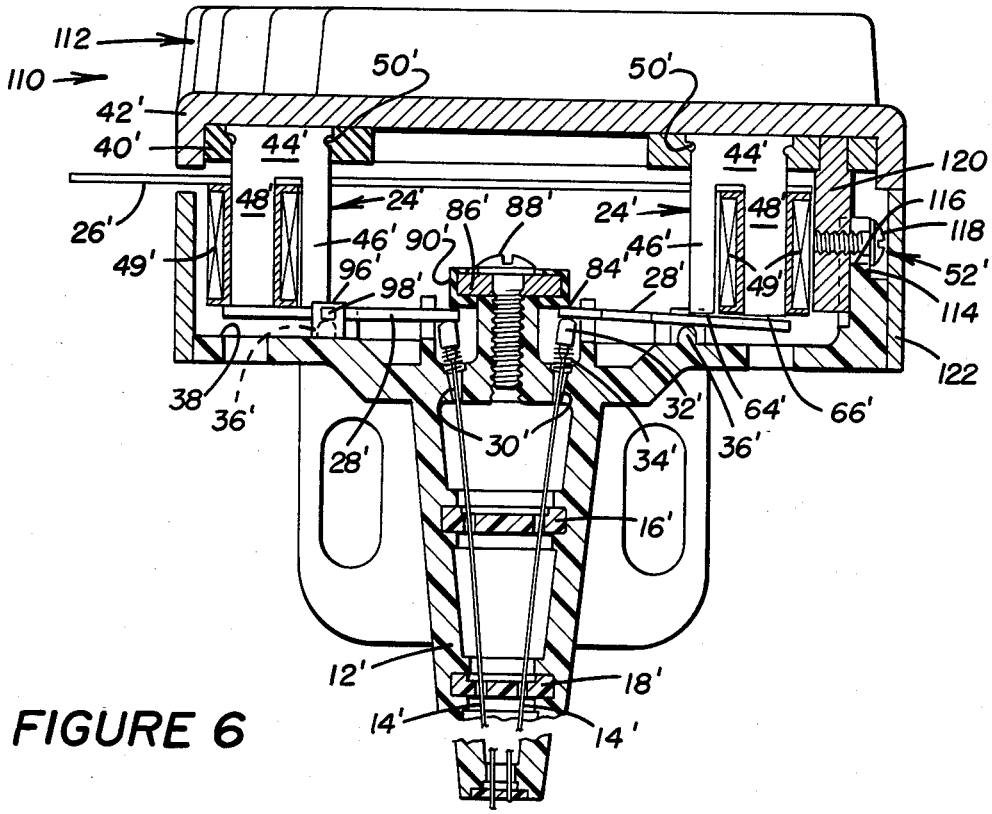
FIGURE 6

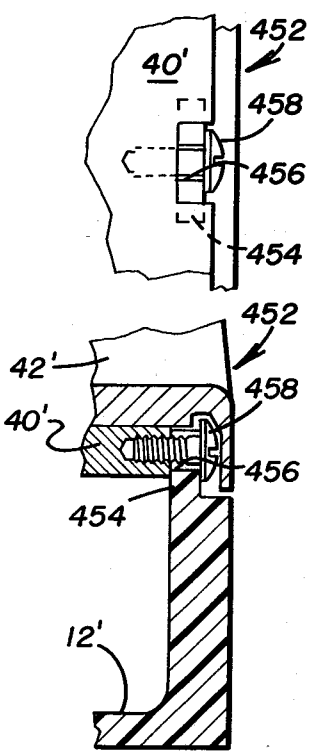
FIGURE 11B
FIGURE 11A
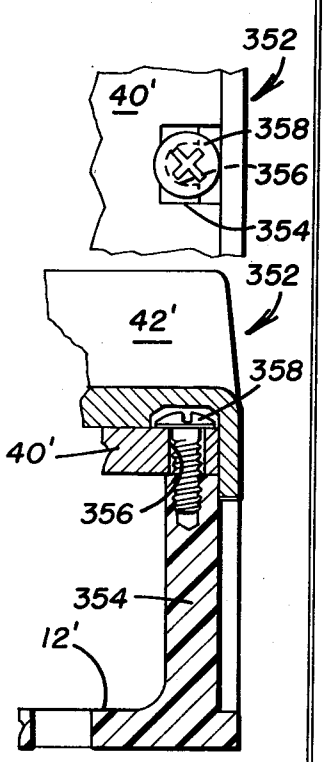
FIGURE 10B
FIGURE 10A
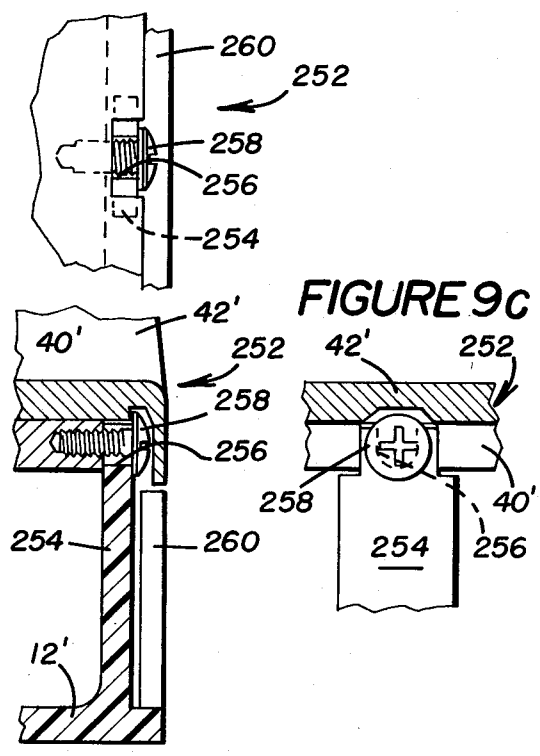
FIGURE 9B
FIGURE 9C
FIGURE 9A
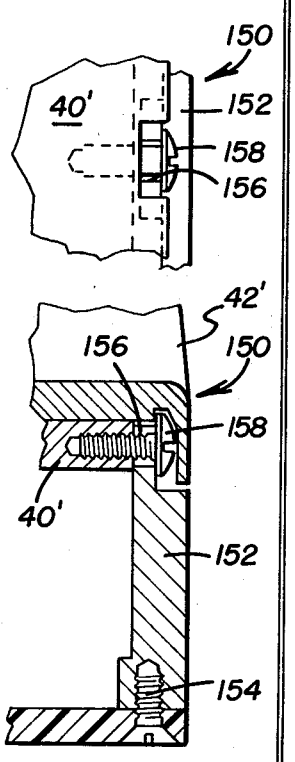
FIGURE 8B
FIGURE 8A

WIRE MATRIX PRINT HEAD

BACKGROUND OF THE INVENTION

The present invention relates to a wire matrix print head for use in printing apparatus and more particularly to an improved version of such a print head which is adapted for high speed operation while maintaining accurate alignment of its operating parts to assure reliability during use.

A number of print heads of the type contemplated by the present invention have been disclosed in the prior art. Such devices, which are commonly termed wire matrix print heads or mosaic print heads, have been employed for some time in teleprinters and the like and more recently in data processing equipment where high speed operation is particularly important.

In such devices, characters are printed in dot matrix form by a plurality of print wires which are respectively operated by separate electromagnetic units so that selected combinations of the wires are driven into a print position as the print head moves across the page or other surface upon which the printing is being performed.

Relatively early examples of wire matrix print heads have been disclosed by U.S. Pat. Nos. 3,333,667 issued Aug. 1, 1967 to Nordin; 3,828,908 issued Aug. 13, 1974 to Schneider and 4,009,772 issued Mar. 1, 1977 to Glaser, et al. These patents are typical of prior art relating to such print heads and illustrate that these print heads tend to operate in the same general manner. The printing head is passed line by line over the page or sheet to which the printing is to be applied. the electromagnetic units are operated by suitable circuitry of similar design and function so that the respective wires are shifted in various combinations between print and non-print positions. As the wires are shifted toward their print positions, they act upon the paper through a ribbon or the like in order to apply a matrix of dots upon the paper. This matrix of dots creates characters in the form of letters, numbers, or other selected symbols.

With the more recent demands for reliable and high speed operation of such print heads in data processing equipment and the like, it has become increasingly important to precisely control relative operation and movement of the electromagnetic units, the armatures and the print wires within the print head to produce uniform quality characters in printing.

At the same time, it is also important to provide reliable means for economically producing and assembling the print heads while making them capable of reliable high speed operation over extended periods of time. In order to provide rapid and accurate reaction of the armatures and print wires to operation of the respective electromagnetic units, the electromagnetic units are typically arranged in circumferential fashion with the armatures extending radially inwardly for interaction with an axially extending circumferential arrangement of print wires held by suitable guides.

With such an arrangement, relatively limited pivoting movement of the armature results from energization of the respective electromagnetic units. Each armature is thereupon pivoted from a rest or non-print position toward a print position so that it strikes a corresponding print wire and urges the print wire into a print position in order to produce characters by dot matrix formations in the manner described above.

When each electromagnetic unit is thereafter de-energized, both the print wire and the respective armature are returned to their rest or non-print positions, typically by means of a spring acting upon each print wire.

More recent versions of such wire matrix print heads adapted for use in data processing equipment and the like are disclosed for example in U.S. Pat. Nos. 4,051,941, 4,185,929 and 4,230,412 issued to Hebert on Oct. 4, 1977, Jan. 29, 1980 and Oct. 28, 1980, respectively. Each of these patents disclosed a print head of the type summarized above. These patents are also representative of efforts to satisfy the requirements of high speed operation and reliability in such print heads. The last noted patent in particular disclosed such a print head including a combination of print wires, armatures and respective electromagnetic units operable in the manner disclosed above and contained and supported within a housing formed of multiple portions which are secured together in order to provide operating alignment between the various components. In particular, one housing portion of the last noted patent was adapted to mount the electromagnetic units and another portion provided the axial guides for the print wires. The armatures were captured in proper orientation between the respective print wires and electromagnetic units upon assembly of the housing portions. Critical spacing between the operating components was established by means of a threaded fastener extending axially through the center of one housing portion for attachment to the other portion. In addition to securing the two housing portions in engagement with each other, the threaded fastener also serves to provide adjustment for a resilient O-ring member which functioned to limit return of the armatures and print wires from their print positions, to thereby establish the rest or non-print positions for those elements.

The construction shown by such references demonstrates the desirability in more recent print head designs of facilitating assembly of the print head while assuring continued alignment of the parts over extended periods of high speed operation.

However, further improvement remains desirable both in assembly of the print head and in assuring its precise and reliable operation over extended periods of time. In particular, because of the very rapid operation of the electromagnetic units and resulting movement of the armatures and print wires between their print and non-print positions, it has been found difficult to assure precise alignment of those components. Such alignment is of course essential in order to achieve uniform striking of the print wires as they approach their print positions. It has also been found difficult to limit undesirable generation of noise and heat during extended print head operation while at the same time assuring reliable operation.

Accordingly, there has been found to remain a need for further improvements in such wire matrix print heads which will further facilitate their assembly while assuring proper relative alignment and spacing between their operating components including print wires, armatures and electromagnetic units.

SUMMARY OF THE INVENTION

It is therefore an object of the invention to provide an improved wire matrix print head of the type referred to above while achieving one or more operating advantages of the type discussed above.

It is a further object of the invention to provide a wire matrix print head including a housing of multiple portions which are interconnected in a manner to precisely establish relative spacing and arrangement between operating components including electromagnetic units, armatures and print wires.

It is a further object of the invention to provide such a wire matrix print head wherein its operating components are generally arranged in circumferentially spaced apart relation, the two housing portions being interconnected by multiple fastening means arranged in spaced apart relation about the peripheries of the housing portions in order to more accurately establish and maintain accurate positioning of the operating components therein. It is preferably contemplated that accurate spacing achieved between the housing portions by the multiple fastening means arranged about the periphery of the housing serve to establish and maintain accurate positioning of the armatures relative to their respective electromagnetic units and print wires. Even more preferably, the wire matrix print head includes an axially extending housing portion which provides support for the print wires during their movement between print and non-print positions. One housing portion is associated with the axially extending housing portion to provide print mountings for the armature while a second housing portion provides mounting means for the electromagnetic units, the housing portions thus establishing uniform spacing and interaction for the armatures with the respective print wires.

It is a related object of the invention to provide such a wire matrix print head where the multiple fastening means include adjustable means for varying spacing and/or planar alignment between the housing portions.

It is another object of the invention to provide a wire matrix print head including multiple housing portions for supporting and maintaining accurate alignment of armatures relative to respective electromagnetic units and print wires, a separate reaction element being provided for interaction with the armatures in order to limit or arrest movement of the armatures as they return from their print positions and thereby establish a rest or non-print position for the armatures. Preferably, the reaction element is rigidly secured to a portion of the housing in order to precisely establish the rest or non-print position of the armatures during assembly of the print head.

It is a further object of the invention to provide an improved pivot mounting for the armatures within a wire matrix print head of the type referred to above. More specifically, according to the present invention, the pivot mounting for each armature is formed by an edge of an associated electromagnetic unit and a pivot means arranged upon the housing opposite the electromagnetic unit edge with the respective armature mounted therebetween, the electromagnetic unit edge and the pivot means being offset relative to each other along the length of the armature while being spaced apart from each other for receiving the armature therebetween, the spacing between the pivot means and the edge being just sufficient to permit pivoting movement of the armature. Preferably, the pivot means is rounded adjacent its apex in order to better maintain the armature in engagement with the edge of the electromagnetic unit during pivoting movement of the armature.

It is yet another object of the invention to provide an improved mounting for each of a plurality of pivoting armatures in a wire matrix print head of the type referred to above, the improved mounting serving to better maintain each armature in engagement with its pivoted support while also facilitating response of each armature to its respective electromagnetic unit. In this regard, the improved mounting for each armature preferably includes a resilient bushing arranged for engagement with a central portion of each armature adjacent its pivot support. Even more preferably, each resilient bushing is compressed slightly upon assembly of the print head in order to better maintain accurate positioning of its respective armature, the resilient bushing being adapted for allowing pivoting movement of the armature into a print position while tending to maintain or return the armature to a rest or non-print position. In a preferred embodiment, each armature is formed with a pair of laterally extending arms arranged on opposite sides thereof, resilient bushings surrounding each of said laterally extending arms for producing the effects referred to above.

Additional objects and advantages of the invention are made apparent in the following description having reference to the accompanying drawings.

BRIEF DESCRIPTION OF THE DRAWINGS

FIG. 1 is a perspective view of a dot or wire matrix print head constructed in accordance with the present invention.

FIG. 4 is an enlarged fragmentary view in full section of the print head to better illustrate the relative positioning and arrangement of operating components within the print head.

FIG. 4A is a fragmentary radially outwardly facing view, with parts in section of a reaction member of the print head of FIG. 4 taken from beyond the periphery of a boss supporting the reaction member.

FIG. 6 is a fully sectioned side view in elevation of another embodiment of a wire matrix print head constructed according to the present invention.

FIG. 7 is a plan view of the print head of FIG. 6 with portions being broken away to better illustrate its internal construction, the view in FIG. 6 being taken along section line 6—6 of FIG. 7.

FIGS. 8A–B, 9A–C, 10A–B and 11A–B respectively illustrate alternative fasteners suitable for arrangement about the periphery of the print head according to the invention in order to establish and maintain spacing between different housing portions and thereby precisely control relative spacing and arrangement of operating components therein.

DESCRIPTION OF THE PREFERRED EMBODIMENTS

Figure 3:
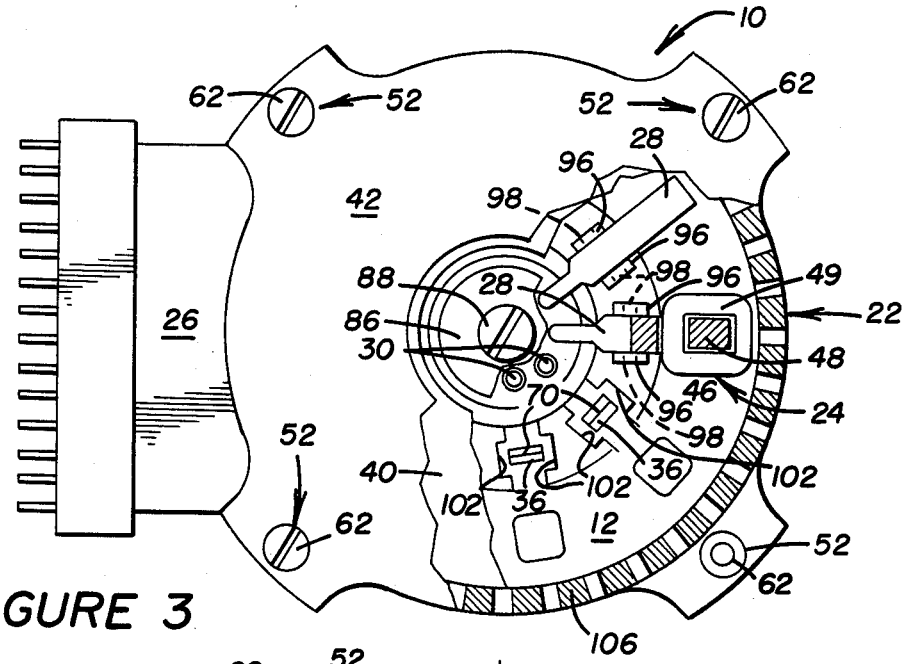
FIG. 3 is a plan view of the print head of FIG. 1 similarly shown with portions being broken away to illustrate its internal construction.

A wire matrix print head constructed in accordance with the present invention and including nine print wires is indicated at 10 in FIGS. 1–4. The print head 10 includes an axially elongated housing portion 12 containing print wires 14. The print wires 14 are spaced about a central axis 68 of print head 10 and are longitudinally movable between print and non-print positions while being supported by spaced apart guides 16 and 18 mounted within the wire housing portion 12. Additional support for the print wires 14 is formed in the nose 20 of the wire housing portion 12 preferably by means of a ruby bearing or the like (not shown). The print wires 14 are extendable in various combinations from the nose 20 of the print head in conventional fashion for printing characters on paper or the like as the print head is moved along the paper in conventional printing apparatus (not shown).

Within such an arrangement, it is of course necessary to very rapidly drive selected combinations of the print wires into their print positions in order to achieve high speed printing of characters as is conventionally contemplated within printing apparatus of the type referred to above. Operating components of the print head for driving the respective print wires 14 are arranged in a portion 22 of the housing.

Figure 2:
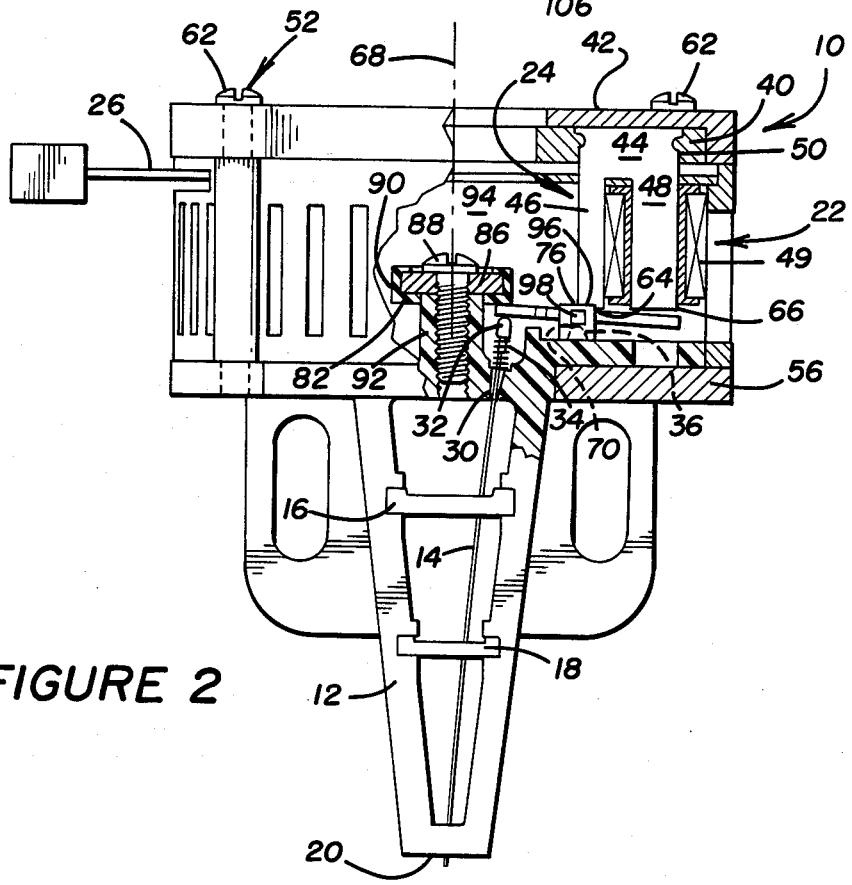
FIG. 2 is a side view in elevation of the print head of FIG. 1 with portions being broken away to better illustrate internal construction of the print head.

Referring also to FIGS. 2–4, and particularly FIG. 4, these operating components include a plurality of electromagnetic units 24 which are energized by external circuitry (not shown) which is interconnected with the respective electromagnetic units 24 through a connector or printed circuit board 26. As each of the electromagnetic units 24 is energized, it causes one of a plurality of armatures 28 to pivot into engagement with a respective one of the print wires 14 for driving the print wire downwardly through wire housing portion 12 into a print position extending from the nose 20 of the print head 10. Accordingly, different combinations of the electromagnetic units 24 are energized in rapid succession for causing different combinations of print wires 14 to be shifted into their print positions for achieving the printing of characters as the print head moves across a sheet of paper or the like.

General operation of the print head 10, including energization of selected combinations of the electromagnetic units 24 for producing rapid movement of the print wires 14 to produce characters on paper, is well known in the prior art and accordingly is not dealt with in further detail below. Rather, the present invention is particularly concerned with the precise mounting and relative arrangement of operating components within the print head. More particularly, the invention concerns precise interaction between the armatures and electromagnetic units for operating the respective print wires and the formation of housing components as described in greater detail below for assuring proper alignment and interaction of those operating components.

Continuing with reference to FIGS. 1–4, the print wires 14 are in a generally conventional matrix configuration within the nose 20 of the print head while being expanded by the guide 16 and 18 into a circumferential arrangement adjacent the print head portion 22 as may be best seen with combined reference to FIGS. 3 and 4. Referring particularly to FIG. 4, the upper ends of the print wires 14 extend through respective guide holes 30 in the wire housing 12. Enlarged heads 32 are formed on the upper ends of the wires for engagement with the respective armatures 28. Springs 34 are arranged for interaction between the wire housing 12 and the enlarged head 32 of each print wire in order to urge the print wires 14 upwardly into a non-print position. When the respective print wires 14 are driven downwardly against their springs 34, they enter into a print position with their lower ends (not shown) extending outwardly from the nose 20 of the print head.

The armatures 28 are of elongated configuration as may also be best seen in FIGS. 2–4. The corresponding electromagnetic units 24 are arranged in similar circumferentially spaced relation corresponding to arrangement of the print wires 14 so that each of the radially extending armatures 28 is operable by the corresponding electromagnetic unit 24 for driving a corresponding print wire 14 downwardly into its print position.

Because of the high speed operation contemplated for the print head 10 and the need for applying uniform pressure to the print wires 14 for optimum printing characteristics, it is particularly important that the operating relation and position of the armatures 28 relative to both the print wires 14 and electromagnetic units 24 be closely established and maintained within the print head.

At the same time, it is also desirable that the design of the print head 10 be suitable for facilitating its assembly and at the same time establishing precise relative arrangement of the above operating components. The construction of the operating components and housing portions of the print head 10 are described below for accomplishing those purposes.

Referring again to FIG. 4, the elongated armatures 28 are supported for pivoting movement on respective pivot ribs 36 formed on an upper surface 38 of the wire housing 12 radially outwardly from the guide holes 30 for the print wires 14.

The electromagnetic units 24 are separately secured to an annular plate 40 forming part of an upper housing portion 42. As may be best seen in FIG. 4, each of the electromagnetic units 24 includes a core 44 having inner and outer pole portions or legs 46 and 48 respectively, and an electrical wire coil 49 conventionally mounted on leg 46. Wires from each coil are connected to printed circuit board 26. With the cores 44 being circumferentially arranged and precisely secured upon the plate 40, the inner legs 46 extend radially inwardly toward the print wires 14. As is indicated at 50, the cores 44 are preferably secured to the plate 40 by press fit or swaging.

With the electromagnetic units 24 thus being affixed to the upper housing portion 42 and the armatures 28 being supported on the pivot ribs 36 formed on the lower wire housing 12, precise spacing and alignment is critical between the housing portions 12 and 42 in order to assure similar precision alignment for the respective armatures 28 with the corresponding electromagnetic units 24 and print wires 14. Accordingly, spacing between the housing portions 12 and 42 is precisely established by a plurality of fasteners 52 arranged about the periphery of the housing portions.

In the embodiment of FIGS. 1–4, each of the fasteners 52 includes a spacer or post 54 for closely establishing spacing between the upper housing portion 42 and a cage 56 having a counterbore 58 for receiving an annular projection 60 on the wire housing 12. As may be seen in FIG. 4, the upper and lower ends of each of the spacer posts 54 engage the upper housing portion 42 and the cage 56 respectively while being held in place by means of screws 62.

The upper housing portion 42 including the plate 40 as well as the wire housing 12 and cage 56 are precision formed, for example by casting so that when they are secured together by the fasteners 52, a uniform and predetermined space or gap is formed between the electromagnetic units 24 and the respective pivot ribs 36 for receiving the armatures 28.

After the cores 44 are secured to the plate 40 in the upper housing portion 42, the lower surfaces 64 and 66 of the inner and outer legs 46 and 48 for each of the electromagnetic units 24 are precisely ground to form a planar surface which is exactly perpendicular to the axis 68 of the print head.

Precision casting or forming of the wire housing 12 similarly assures that the combined pivot ribs 36 have their uppermost points or apexes 70 (also see FIG. 5) lying in a plane which is also exactly perpendicular to the axis 68 of the print head. Thus, when the housing portions 42 and 12 are secured together by means of the fasteners 52, the lower surfaces 64 and 66 of the combined electromagnetic units 24 are precisely parallel and uniformly spaced apart from the apexes 70 of the pivot ribs 36.

With the electromagnetic units 24 and pivot ribs 36 being fixed relative to each other by the housing portions 42 and 12 and the fasteners 52, the spacing between the lower surfaces 46 and 48 of the electromagnetic cores 44 and the apexes 70 of the pivot ribs 36 is just greater than the thickness of the armatures 28. Preferably; the spacing between the surfaces 64 and 66 and the apexes 70 is about two thousands of an inch greater than the thickness of the armature in order to precisely position the armatures 28 while allowing them to pivot in a manner described in greater detail below.

Figure 5:
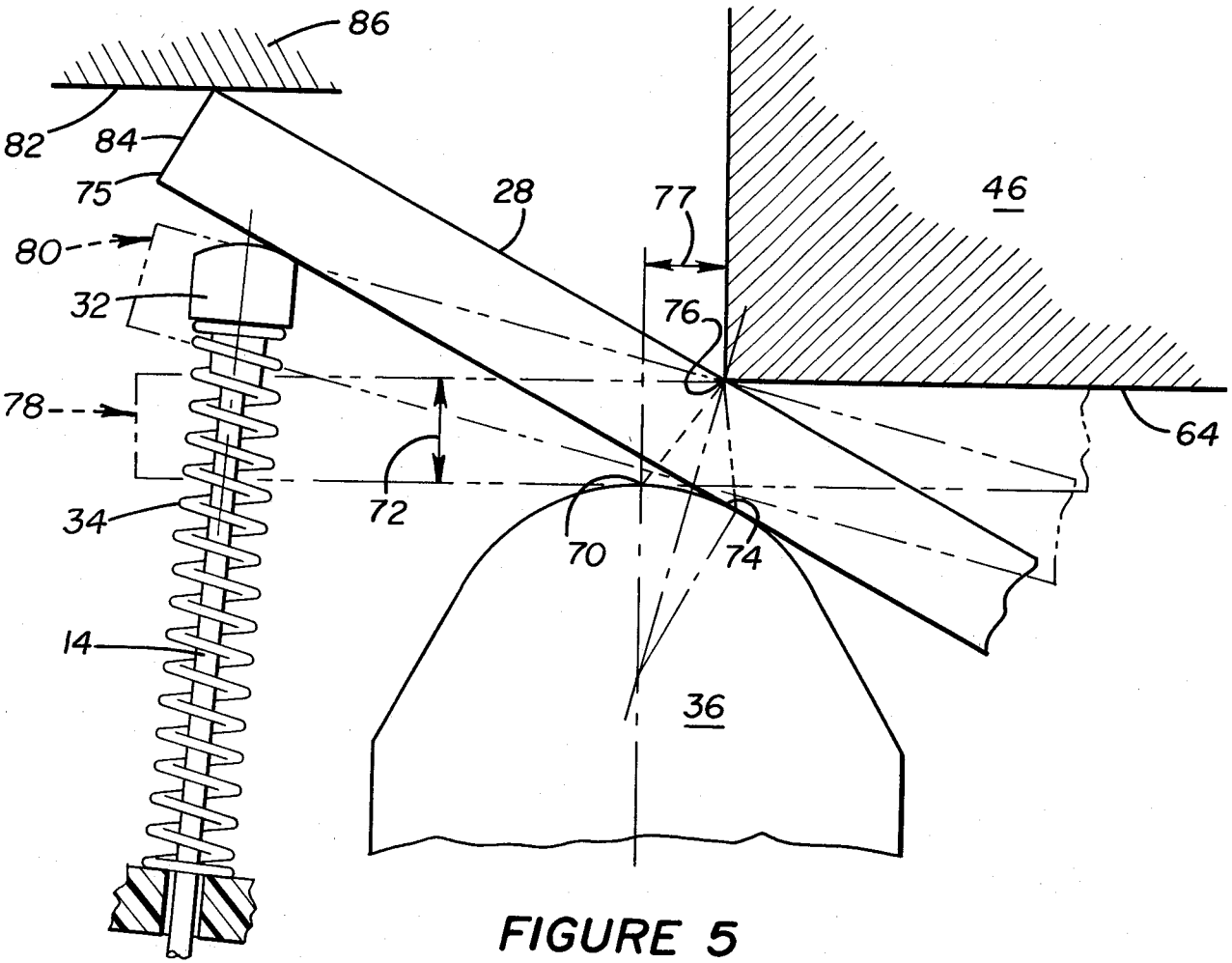
FIG. 5 is a further enlarged fragmentary view of a pivot mounting for each of the armatures in the print head of FIGS. 1–4.

Referring also to FIG. 5, angular movement of the armature 28 is exaggerated in order to better illustrate its pivotable movement between the pivot rib 36 and the lower surface 64 of the inner core leg 46. Spacing between the surface 64 and the apex 70 of the pivot rib 36 is indicated at 72 and is only slightly greater than the corresponding thickness of the armature 28 as described immediately above.

With each of the armatures 28 thus captured during assembly of the print head, a pivot assembly for each of the armatures is formed in combination by the apex 70 and adjacent upper surface 74 of the pivot rib 36 together with an inner edge 76 of the inner core leg 46. The apex 70 of the pivot rib 36 is spaced radially inwardly from the inner edge 76 in order to better facilitate pivotable movement of the armature 28 from its rest or non-print position 75 illustrated in solid lines to a print position illustrated in phantom at 78 and an intermediate position also illustrated in phantom at 80.

Normally, the armature 28 and the corresponding print wire 14 are urged upwardly by compression stress in the wire 14 directed axially and caused by striking force of the armature and wire head. In other words, the wire 14 is buckled upon impact by the armature and wire head. When the magnetic force on the armature is released, the wire tends to spring back from its buckled condition, resulting in the upward force referred to above. The spring 34 also contributes to upward force applied to the respective wire 14. However, the main function of the spring 34 is to normally retain the wire 14 in a rest or non-print position established when an inner end 84 of each armature 28 abuts a reaction surface 82. Construction and arrangement of the reaction surface 82 within the print head is described in greate detail below.

In addition to the critical axial spacing between the apex 70 of the pivot ribs 36 and the inner edges 76 and lower surfaces 64 of the cores 44, the radially offset relation of the apex 70 of each pivot rib 36 relative to the corresponding inner core edge 76 is also of critical importance, as indicated at 77 in FIG. 5. Preferably, the radial offset between the edge 76 and the apex 70 is in the range of about 0.0024 inches to about 0.0055 inches.

These critical features of spacing and shaping for the inner core pole 46 and the corresponding pivot rib 36 serve to precisely regulate pivotal movement of the armature 28 between its rest position, shown in solid line at 28, and in its print position, indicated in phantom at 78. It may be seen in FIG. 5 that when the armature 28 is in its rest position 75, it is supported or captured between the inner edge 76 of the core pole 46 and the rounded surface 74 of the pivot rib 36 some distance from its apex 70.

When the corresponding electromagnetic unit 24 including the pole 46 of FIG. 5 is energized, the armature is urged into an abutting engagement with the lower surface 64 of the pole so that the armature 28 assumes its print position 78. As the armature moves from its non-print position 75 to its print position 78, it remains in contact with the inner edge 76 of lower surface 64 of the core pole 46 while engagement of the lower surface of the armature shifts along the surface 74 until it is supported on the apex 70 in its print position 78.

As the armature 28 moves from its non-print or rest position 75 toward its print position 78, the corresponding print wire 14 is driven downwardly into a print position. Thus, the inner edge 76 and pivot rib 36 provide in combination a single pivot means which faciliates operation of the respective armature and permits maximum transfer of its kinetic energy to the associated print wire.

Thereafter, when the electromagnetic unit 24, including the inner pole 46 illustrated in FIG. 5, is deenergized, the corresponding print wire 14 and armature 28 are again urged upwardly into their non-print positions with the inner end 84 of the armature 28 in engagement with the reaction surface 82. In order to maintain precise uniform control over the complete array of armatures 28, it is accordingly essential that the reaction surface 82 also be exactly perpendicular to the axis of the print head and parallel to the planes formed by the surfaces 64 for all of the electromagnetic units 24 and the plane formed by the apexes 70 of the pivot ribs 36.

The function and arrangement of the reaction surface 82 for achieving this purpose may be best seen with specific reference to FIG. 2. As shown therein, the reaction surface 82 is formed by a reaction member 86 which is secured to the wire housing 12 by means of a threaded bolt 88 acting against a boss 92 formed on wire housing 12. The reaction surface 82 may comprise an elastomeric or resilient coating 90 formed on reaction member 86. Such an elastomeric coating 90 would enable reaction surface 82 to be generally resilient so as to provide a damping effect when it is contacted by the inner end 84 of each armature 28. At the same time, the reaction member 86 may seat against the boss 92 into which the bolt 88 is threaded to precisely locate the reaction surface 82.

An alternate embodiment of a reaction surface assembly is illustrated with reference to FIGS. 4 and 4A. As shown therein, the reaction surface 82' is formed by a reaction member 500 secured by a threaded bolt 88' to a boss 92' formed on the wire housing 12. The reaction member 500 includes an intermediate resilient layer 500A and a lower resilient layer 500B of relatively reduced diameter. The surface 82' is formed by the lower layer 500B. A ring 502 resting on or integrally formed with the wire housing 12 comprises circumferentially spaced-apart posts 504 arranged between the armatures 28. The upper ends 505 of the posts 504 slip past the lower resilient layer 500B on the reaction member and impinge the intermediate resilient layer 500A, as shown in FIG. 4A.

Interaction of the posts 504 with the reaction member 500 fixes planar alignment of the surface 82' in precise perpendicular relation to the axis 68. Protrusions 506 of the intermediate layer 500A about the posts 502 also prevents relative rotation of the reaction member 500 with respect to housing 12. Thus, planar and angular alignment of the reaction member 500 are precisely established by the ring 502.

An alternative means for fixing reaction member 500 (not shown) would be to form layer 500A as a molded piece made of plastic or the like which includes ridges or other mechanical shapes positioned to fit adjacent to and between one or more posts 504 and prevent thereby relative rotations between reaction member 500 and housing 12.

Pivotal operation of the armatures 28 is further enhanced by resilent bushings 96 which serve to better maintain the armatures in engagement with the pivot ribs 36 while also providing a damping effect during pivoting operation of the armatures. This damping effect tends to reduce undesirable oscillation of the armatures while also minimizing noise during operation of the print head.

In order to assure proper interaction between the bushings 96 and the armatures 28, each of the armatures is formed with arms 98 laterally extending from opposite sides of the armature adjacent the apex 70 of the pivot rib 36. The arms 98 are preferably rectangular and fit into similarly shaped openings in each of the bushings 96. A separate bushing 96 is arranged on each of the arms 98 of the armature. Bushings 96 are also preferably rectangular and are captured and slightly compressed by being forced into slots 102, shown in FIG. 3, formed on opposite sides of each of the pivot ribs 36. The resilient character of the bushings is selected to permit pivotable movement of the armatures 28 between their rest or non-print positions and print positions as best illustrated in FIG. 5. At the same time, the resilient character of the bushings serves to dampen movement of the armature for purposes described immediately above. Preferably, the bushings 96 have a Durometer hardness of about 80 for this reason.

Different portions of the print head 10, as seen in FIG. 3, are shown with different combinations of operating components in order to better illustrate construction and assembly of the operating components as well as the wire housing 12. For example, two positions are shown without the armature 28, bushings 96 or electromagnetic unit 24 in order to better illustrate formation of the pivot ribs 36 and adjacent slots 102 for receiving the bushings 96. Another location shows the armature 28 and bushings 96 in place without the electromagnetic unit 24 while yet another position shows the armature 28, bushings 96 and a sectioned portion of the electromagnetic unit 24 in place. It is of course understood that all of the operating components referred to above are present at each of these locations when the print head is fully assembled.

In addition to the print and non-print positions for the armatures 28 and print wires 14 as illustrated in FIG. 5, it may also be seen that the armature 28A and print wire 14A, as seen on the right side of FIG. 4, are illustrated in their non-print positions. By contrast, the armature 28B and corresponding print wire 14B, as seen on the left side of FIG. 4, are illustrated with the corresponding electromagnetic unit 24B being energized so that the armature 28B and print wire 14B are shifted into their print positions, as discussed in greater detail above.

With the print head 10 being completely assembled, as may be best seen in FIG. 1, the upper housing portion 42 and the plate 40 are formed with an axial opening 104 which is in communication with an open region 94 along the axis 68 of print head 10 within the print head (see FIG. 4). At the same time, a slotted cage or housing member 106 is captured between the upper and lower housing portions 42 and 12 adjacent the fastners 52 in order to facilitate the passage of air through the print head 10 for cooling purposes.

The embodiment illustrated in FIGS. 1–5 and described in detail above includes 9 print wires. Another embodiment of a wire matrix print head constructed in accordance with the present invention is illustrated in FIGS. 6 and 7 and includes 18 print wires and corresponding armatures and electromagnetic units. The 18 wire print head is generally indicated at 110 and includes substantially the same features described above for the print head 10. Accordingly, components of the 18 wire print head 110 which are similar to those of the 9 wire print head 10 are indicated by similar primed numerals.

Only those features of the 18 wire print head 110 which are substantially different from the preceding description are described below in order to permit a better understanding of the present invention. In particular, FIGS. 6–11 illustrate a variety of fasteners arranged about the periphery of the print head for establishing and maintaining relative alignment of internal operating components such as the armatures and electromagnetic units. It will of course be immediately apparent that such features could also be employed in the nine wire print head of FIGS. 1–5.

Having reference now to FIGS. 6 and 7, it is noted that the internal construction and assembly of the print head 110 is substantially similar to that described above for the nine wire print head. The major exception of course is that the circumferential spacing of the print wires, armatures and electromagnetic units in the print head 110 is much more compact because of the large number of components. Although the print head 110 includes a substantially greater number of operating components, it is particularly to be understood that the construction and arrangement of those operating components is substantially similar to the embodiment of FIGS. 1–5 as described above.

Except for the increased number of components for operating the 18 print wires, the print head 110 differs from the print head 10 of FIGS. 1–5 principally in external features. For example, the upper housing member 42' may be formed with a finned heat sink 112 to facilitate cooling of the print head 110.

The print head 110 also includes a plurality of fasteners 52' arranged about the periphery of the upper and lower housing portions 42' and 12' for securing them together in precisely spaced-apart relation for maintaining internal operating components in proper operating alignment. Additional variations which are possible for fasteners peripherally arranged about the print head 110 are illustrated in composite FIGS. 8–11 and described below.

Referring now particularly to FIGS. 6 and 7, the fasteners 52' are adapted to permit adjustment of the spacing between the upper and lower housing members 42' and 12' in order to assure proper spacing and planar alignment of the various operating components as was described in detail above in connection with the embodiment of FIGS. 1-5.

Each of the adjustable fasteners 52' includes a post 114 which is integral to the lower wire housing portion 12' and extends upwardly with a slot 116 being formed in its upper end. A screw 118 passes through the slot 116 and is threaded into engagement with a cylindrical extension 120 rigidly attached to the upper housing member 42'.

With similar fasteners 52' arranged about the periphery of the print head 110, it may thus be seen that both spacing and planar alignment are selectively adjustable between the upper housing member 42' and the lower wire housing member 12' upon assembly. After assembly, an external housing member or cover 122 is slipped into place about the periphery of the print head 110 in order to limit access to the screws 118 and thereby better maintain proper operating alignment within the print head 110.

As noted above, additional variations for the fasteners 52' are illustrated respectively in each of FIGS. 8-11. It is of course to be understood that each of the fasteners 52' about the periphery of the print head 110 in FIGS. 6 and 7 could be replaced by any one of the variations shown in FIGS. 8-11.

Referring initially to FIG. 8, an adjustable fastener 150 is shown which is generally similar to the fastener 52' of FIGS. 6 and 7 except that a vertical post 152 corresponding to the post 114 of FIGS. 6 and 7 is separately formed and attached to the lower housing portion by means of a screw 154. Otherwise, the upper end of the post 152 is slotted as indicated at 156 for receiving a screw 158 corresponding to the screw 118 of FIGS. 6 and 7. As may be seen at the top of FIG. 8A, the screw 158 is adapted for engagement with the plate 40' on which the electromagnetic units (see FIG. 4) are mounted. After critical spacing is established between the plate 40' and the lower housing number 12', the upper housing member 42' may then be arranged in place for example by snap fit engagement over the plate 40'. Thus, this arrangement would similarly prevent access to the screws 158 after final assembly of the print head. Note that FIG. 8B shows a plan view of the fastener arrangement of FIG. 8A with the upper housing 42' removed to better illustrate construction of the fastener 150.

Another fastener configuration is illustrated at 252 in each of FIGS. 9A-9C. The fastener 252 provides spacing adjustment between the upper housing portion 42' and 40' and the lower wire housing 12' in generally the same manner described above in the embodiment of FIGS. 8A and B and the embodiment of FIGS. 6 and 7. In FIGS. 9A-C, a post 254 is integrally formed with the lower wire housing 12' while being slotted as indicated at 256 for receiving a screw 258. As in the embodiment of FIGS. 8A AND 8B, the screw 258 engages the plate 40'. A cylindrical housing member or cover 260 surrounds the posts 254 of the print head while the upper housing plate 42' is secured to the print head in overlapping relation with the screws 258 again in the same manner described in FIGS. 8A and 8B.

Another embodiment of a fastener is indicated at 352 in each of FIGS. 10A and 10B. As in the embodiment of FIG. 9, posts 354 are integrally formed with the lower wire housing member 12'. In each fastener 352, a screw 358 is adapted for passage through an opening 356 in the plate 40' for threaded engagement with the top of the post 354. As in the embodiments of 8A-B and 9A-C, the upper housing member 42' is adapted for engagement with the print head in overlapping relation with the screws 358.

Unlike the embodiments of FIGS. 6-7, 8 and 9, the embodiment of FIG. 10, as shown, does not provide for adjustment in the spacing or planar alignment between the lower wire housing 12' and the upper housing member 42' with plate 40'. Rather, the screw 356 is merely tightened so that the plate 40' is brought into close engagement with the post 354. However, even in the embodiment of FIG. 10, some adjustment would be possible, for example, through the use of shims (not shown) placed between the plate 40' and the post 354.

Yet another embodiment of a fastener is indicated at 452 in each of FIGS. 11A and 11B. The embodiment of FIGS. 11A and 11B is substantially similar to that of FIGS. 8A and 8B except that posts 454 are formed as integral extensions of the lower wire housing portion 12'. Otherwise, as in the embodiment of FIGS. 8A and 8B, the post 454 is formed with a slot 456 for receiving a screw 458 which is threaded into the plate 40'. The upper housing portion 42' again fits onto the print head in overlapping engagement with the screws 458.

Accordingly, there have been described a number of embodiments of a wire matrix print head constructed in accordance with the present invention. Numerous modifications and variations are obvious within each of the embodiments. For example, features shown in any of the print head embodiments could be adapted for use in any of the other embodiments as well. Accordingly, the scope of the present invention is defined only by the following appended claims.

What is claimed is:

1. In a wire matrix print head with an array of operating components circumferentially arranged about a central axis including a plurality of print wires arranged for longitudinal movement between a print position and a non-print position, guide means for supporting the print wires in their print and non-print positions, means for urging the print wires toward their non-print positions, a radially arranged array of rigid armatures associated with the respective print wires, an end portion of each armature being arranged for engagement with the respective print wire for driving it toward its print position, a circumferential array of separate electromagnetic means associated with the respective armatures, the electromagnetic means being operable for causing movement of the end portion of the respective armature so as to cause said armature to drive the respective print wire toward its print position, and housing means for supporting the print wires, armatures and electromagnetic means in operating relatinship, the improvement comprising means for supporting each of the electromagnetic means opposite the respective armatures from the print wires, each electromagnetic means forming a planar surface perpendicular to said central axis, the inner edge of said planar surface closest to said central axis formed for engagement with the respective armature, and a rigid pivot element arranged opposite each of the armature from said edge of the respective electromagnetic means, each said pivot element having an apex lying in a plane which is perpendicular to said central axis and arranged for engagement with the respective armature in radially spaced apart relation from said edge, said rigid pivot element and said edge being axially spaced apart from each other a predetermined fixed distance to enable pivoting movement of the respective armature therebetween to cause said armature to be in contact with the apex of said pivot element and abutting said planar surface when said electromagnetic means has caused said armature to drive the respective print wire into its said print position.

2. The wire matrix print head of claim 1 wherein axial spacing between said pivot element and said edge is slightly greater than a corresponding dimension of the armature

3. The wire matrix print head of claim 1 further comprising reaction means adapted for engagement with the armatures in order to arrest movement of the armatures as they return from their print positions toward their rest positions.

4. The wire matrix print head of claim 3 wherein said reaction means is arranged along an axial portion of the print head for engagement with the end portions of the armatures which also engage the respective print wires.

5. The wire matrix print head of claim 23 further comprising means for securing said reaction means to said housing means for precisely establishing the rest position of the armatures upon assembly of the wire matrix print head.

6. The wire matrix print head of claim 1 wherein the apex of each said pivot rib is radially offset towards said central axis a predetermined offset distance from said edge of its corresponding electromagnetic means.

7. In a wire matrix print head including a plurality of print wires each arranged for longitudinal movement between a print position and a non-print position, guide means for supporting the print wires in their print and non-print positions, means urging the print wires toward their non-print positions, a separate rigid armature associated with each respective print wires, an end portion of each armature being arranged for engagement with the resepctive print wire for driving it toward its print position, and a separate electromagnetic means associated with each respective armature, the electromagnetic means being operable for cuasing movement of the end portion of the respective armature so as to cause said armature to drive the respective print wire toward its print position, the improvement comprising housing means for supporting the print wires, armatures and electromagnetic means in operating relationship, the housing comprising first and second housing portions, said first housing portion being associated with an axially extending housing portion containing the guide means for supporting the print wires, said second housing portion providing mounting means for said electromagnetic means, said first and second housing portions providing capturing means for said armatures for establishing uniform interaction of the armatures with the impact surfaces of their respective wires, said first and second housing portions including peripheral portions surrounding the armatures and electromagnetic means, multiple fastening means being arranged for interconnection with said first and second housing portions in spaced apart relation about their peripheries in order to establish and maintain accurate positioning of the armatures relative to the respective electromagnetic means, pivot means arranged on said housing means for respective engagement with each of the armatures, and resilient bushing means arranged for engagement with each respective armature adjacent said pivot means, said engagement of said resilient bushing with the respective armature being adapted for allowing pivoting movement of the armature on said pivot means while tending to dampen undesirable movement of the armature, and means associated with said housing means for mounting each said resilient bushing.

8. In a wire matrix print head with an array of circumferentially arranged operating components including a plurality of print wires arranged for longitudinal movement between a print position and a non-print position, guide means for supporting the print wires in their print and non-print positions, means for urging the print wires toward their non-print positions, a radially arranged array of rigid armatures associated with the respective print wires, an end portion of each armature being arranged for engagement with the respective print wire for driving it toward its print position, a circumferential array of separate electromagnetic means associated with the respective armatures, the electromagnetic means being operable for causing movement of the end portion of the respective armature so as to cause said armature to drive the respective print wire toward its print position, and housing means for supporting the print wires, armatures and electromagnetic means in operating relationship, the improvement comprising means for supporting each of the electromagnetic means opposite the respective armatures from the print wires, each electromagnetic means forming an edge for engagement with the respective armature, a pivot element arranged opposite each of the armatures from said edge of the respective electromagnetic means, each said pivot element having an apex arranged for engagement with the respective armature in radially spaced apart relation from said edge, said pivot element and said edge being axially spaced apart from each other for permitting pivoting movement of the respective armature therebetween; and resilient bushing means arranged for engagement with each respective armature adjaeent said pivot element, said engagement of said resilient bushing means with the respective armature being adapted for allowing pivoting movement of the armature on said pivot element while tending to dampen undesirable movement of the armature.

9. The wire matrix print head of claim 8 further comprising means formed on said housing means for receiving each said resilient bushing means in order to position the armature relative thereto.

10. The wire print head of claim 9 wherein said pivot element and said means for receiving said resilient bushing means are integrally formed on a portion of the housing means.

11. In a wire matrix print head including a plurality of print wires arranged for longitudinal movement between a print position and a non-print position, guide means for supporting the print wires in their print and non-print positions, means for urging the print wires toward their non-print positions, a separate rigid elongated armature associated with each respective print wire, an end portion of each armature being arranged for engagement with the respective print wire for driving it toward its print position, a separate electromagnetic means associated with each respective armature, the electromagnetic means being operable for shifting the respective armature from a rest position to a print position and causing movement of the end portion of the respective armature so as to cause said armature to drive the respective print wire toward its print position, and housing means for supporting the print wires, armatures and electromagnetic means in operating relationship, the improvement comprising pivot means arranged on the housing adjacent a central portion of each of the elongated armatures, said pivot means having an apex arranged for engagement with said central portion of each of the armatures, resilient bushing means arranged for engagement with each respective armature adjacent said pivot means, said engagement of said resilient bushing with the respective armature being adapted for allowing pivoting movement of the armature on said pivot means while tending to dampen undesirable movement of the armature, and means formed on the housing means for receiving each said resilient bushing.

12. The wire matrix print head of claim 11 wherein each of the armatures is formed with a pair of laterally extending arms arranged on opposite sides of each armature adjacent said pivot means, said resilient bushing means including means surrounding each of said laterally extending arms.

13. The wire matrix print head of claim 12 wherein the housing means forms a slot means for receiving and positioning one of said bushing means on each side of said pivot means for receiving said laterally extending arms of each armature.

14. The wire matrix print head of claim 13 wherein a portion of the housing means integrally forms said pivot means and said slot means for receiving said bushing means.

* * * * *

UNITED STATES PATENT AND TRADEMARK OFFICE

CERTIFICATE OF CORRECTION

PATENT NO. : 4,594,010

DATED : June 10, 1986

INVENTOR(S) : Alex Jachno

It is certified that error appears in the above-identified patent and that said Letters Patent is hereby corrected as shown below:

Column 1, line 34, delete the second occurring "the" and insert therefor --The--.

Column 7, line 61, delete "greate" and insert therefor --greater--.

Column 13, line 2, delete "armature" and insert therefor --armatures--.

Column 13, line 19, after "armature" insert --.--.

Column 13, line 29, delete "Claim 23" and insert therefor --Claim 4--.

Column 13, line 53, delete "cuasing" and insert therefor --causing--.

Column 14, line 63, delete "adjaeent" and insert therefor --adjacent--.

Column 13, line 35, delete "rib" and insert therefor --element--.

Signed and Sealed this

Ninth Day of December, 1986

*Attest:*

DONALD J. QUIGG

*Attesting Officer*

*Commissioner of Patents and Trademarks*